United States Patent [19]

Butt et al.

[11] 4,423,745

[45] Jan. 3, 1984

[54] RINSING MACHINE

[75] Inventors: William C. Butt; Buford L. Almond, both of Lynchburg, Va.

[73] Assignee: Simplimatic Engineering Company, Lynchburg, Va.

[21] Appl. No.: 445,252

[22] Filed: Nov. 29, 1982

[51] Int. Cl.[3] ..... B67C 1/047; B08B 9/08

[52] U.S. Cl. ..... 134/62; 134/127; 134/152; 118/317

[58] Field of Search ..... 134/62, 67, 68, 73, 134/72, 127, 131, 152; 118/317, 324

[56] References Cited

U.S. PATENT DOCUMENTS

| | | | |
|---|---|---|---|
| 1,144,023 | 6/1915 | Beutlich | 134/72 |
| 2,681,872 | 6/1954 | McCabe | 134/131 |
| 3,064,663 | 11/1962 | Sariotti | 134/131 |
| 3,556,847 | 1/1971 | Prodzenski | 134/62 |
| 3,583,544 | 6/1971 | Prodzenski | 134/68 |

*Primary Examiner*—Robert L. Bleutge
*Attorney, Agent, or Firm*—James & Franklin

[57] ABSTRACT

A rinsing machine for articles of glassware or the like comprises a pair of endless conveyors, each of the conveyors defining a travel path comprising a flight path and a return path. Each flight path extends from a lower level article-intake segment, through an upwardly-extending article-inversion segment, along an upper flight segment of appreciable length, through a downwardly-extending article-re-inversion segment, and to a lower level article-discharge segment. Each return path is generally parallel to, but horizontally spaced from, the flight path. The machine also includes converging wheels for bringing the conveyors into article-grasping juxtaposition at the article-intake segment, diverging wheels for bringing the conveyors into article-releasing juxtaposition at the article-discharge segment, and retaining guides for retaining the conveyors in the article-grasping juxtaposition between the article-intake and article-discharging segments. The articles traveling along the upper flight segments are rinsed, and then allowed to drip dry.

24 Claims, 11 Drawing Figures

RINSING MACHINE

BACKGROUND OF THE INVENTION

The present invention relates to rinsers and, more particularly, to a rinsing machine for articles of glassware or the like.

The known rinsing machines have not proven to be entirely satisfactory in use for one or more of a variety of reasons. Some rinsers are adapted to handle only articles of a given diameter or width and cannot be easily adjusted to handle articles of a different diameter or width, thereby limiting versatility of the rinser. Some rinsers grasp the articles with such firmness and rigidity that they cannot be used on fragile articles (such as glassware) without frequent breakage of the articles. Some rinsers require that the input feed to the rinser be longitudinally spaced at given intervals so as to enable the articles to fit into quasi-compartments for portage through the rinser.

Thus, the known rinsers are subject to a number of defects. Because of their inability to easily accommodate articles of differeing size it may be necessary to provide separate rinsers for each size of article, and there may be considerable downtime on each rinser if the supply of articles of the appropriate size are inavailable for a given rinser. Because of their inability to handle fragile articles, fragile articles may be marred or broken and thorough cleaning of the machine to remove the breakage may require downtime of the rinser. Because of their inability to receive randomly spaced input, either additional labor or equipment may be required to provide the appropriate spacing to the input queue.

Accordingly, it is an object of the present invention to provide a rinser which is easily adjusted to handle articles of varying diameter.

Another object is to provide such a rinser which safely handles fragile articles.

A further object is to provide such a rinser which can accept a randomly spaced input of the articles to be rinsed.

A final object is to provide such a machine which is safe, economical and easy to operate.

SUMMARY OF THE INVENTION

It has now been found that the above and related objects of the present invention are obtained in a rinsing machine for articles of glassware or the like comprising a pair of endless conveyors, each of the conveyors defining a travel path comprising a flight path and a return path. Each flight path extends from a lower level article-intake segment through an upwardly-extending article-inversion segment, along an upward flight segment of appreciable length, through a downwardly-extending article-re-inversion segment, and to a lower level article-discharge segment. Each return path is preferably generally parallel to, but horizontally spaced from, its associated flight path.

The rinsing machine further comprises converging means for bringing the conveyors into article-grasping juxtaposition at the article-intake segment, diverging means for bringing the conveyors into article-releasing juxtaposition at the article-discharge segment, and means for retaining the conveyors in the article-grasping juxtaposition between the article-intake and article-discharge segments. Means are also provided for driving each of the conveyors along its respective travel path and for rinsing inverted articles traveling along the upper segment.

In a preferred embodiment, the major portions of the flight and return paths are in parallel, vertical planes, the vertical planes of the return paths being spaced outwardly of the vertical planes of the flight paths. The converging and diverging means are horizontally disposed curved guides (preferably wheels rotatable about a vertical axis) disposed adjacent the article-intake and article-discharge segments, respectively. For each of the conveyor flight paths, the flight and return paths are connected at each end by intermediate paths extending around respective ones of the horizontally disposed curve guides and the drive means comprises means for rotating one of the horizontally disclosed curve guides.

For each of the conveyors, preferably there are four generally vertically disposed curve guides, two being disposed along the flight path, one each at the article inversion and re-inversion segments, and two being similarly disposed along the return path (each preferably being a wheel rotatable about a horizontal axis, preferably an idler wheel). For each of the conveyor travel paths, the two vertically disposed wheels at the article-inversion segment are preferably mounted on common horizontal shafts with the two vertically disposed wheels at the article-re-inversion segment being mounted on a common horizontal shaft as well. Means are provided for adjusting the horizontal spacing between the four vertically disposed wheels of one of the conveyor travel paths and the four vertically disposed wheels of the other of the conveyor travel paths, such adjusting means being also effective for adjusting the horizontal spacing between the converging, diverging and retaining means, and hence between the travel paths of the conveyors.

DETAILED DESCRIPTION OF THE PREFERRED EMBODIMENTS

The Conveyor System

Figure 1:
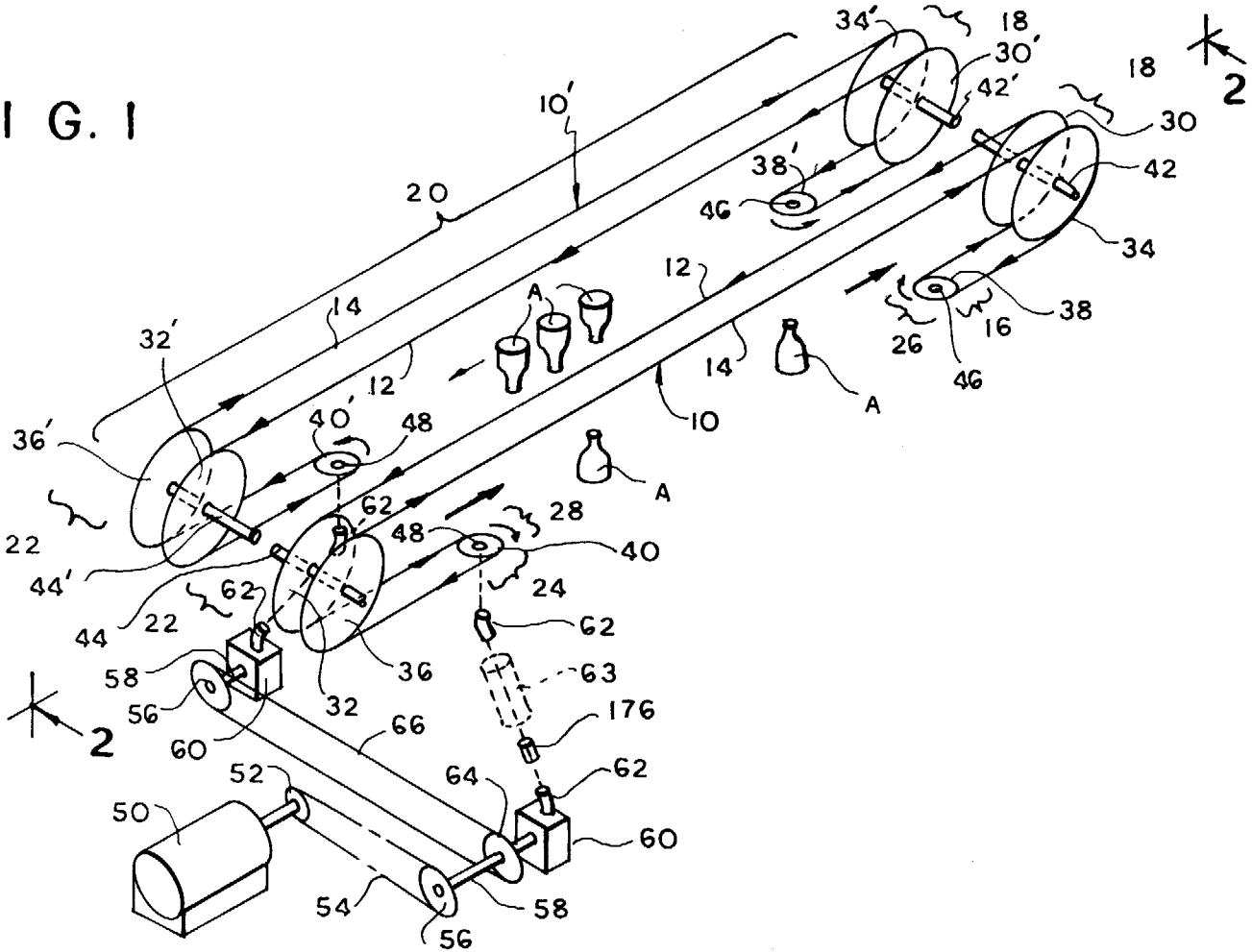
FIG. 1 is an exploded schematic of the conveyors and the drive system therefor.
Figure 2:
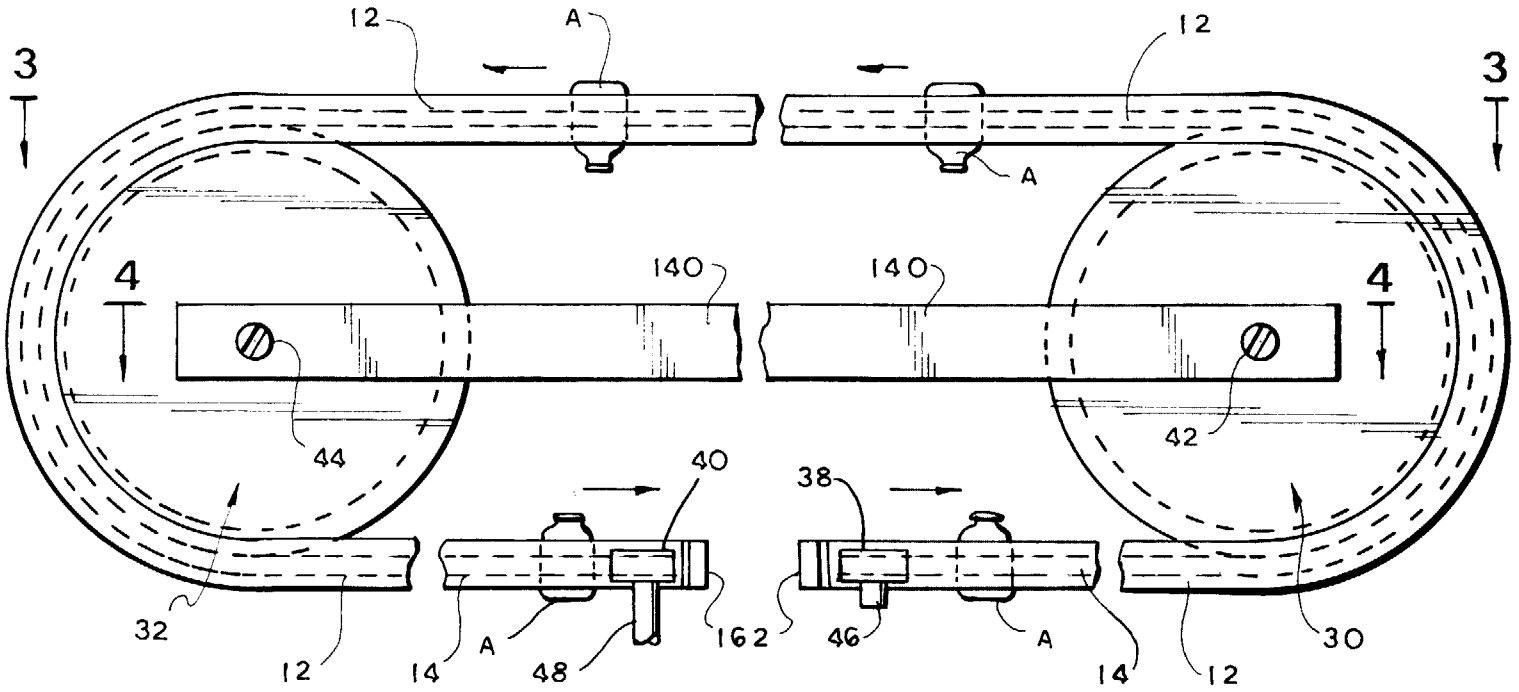
FIG. 2 is a simplified fragmentary side elevation view of particular elements of the rinser taken along the line 2—2 of FIG. 1.

Referring now to the drawing, FIGS. 1 and 2 indicate schematically the overall operation of the apparatus of the present invention. Therein illustrated are a pair of endless conveyors, generally designated by the numerals 10, 10'. Each of the conveyors defines a separate and distinct travel path comprising a flight path 12 and a return path 14. The flight path 12 extends from a lower level article-intake segment 16 where an article (such as glass bottle A on a feed table (not shown)) is grasped between the two conveyors 10, 10' and carried by them through an upwardly-extending article-inversion segment 18, along an upper flight segment 20 of appreciable length, through a downwardly-extending article-re-inversion segment 22, to a lower level article-discharge segment 24, where the article A is discharged onto a discharge table (not shown). The return paths 14 of the conveyors are generally parallel to, but horizontally outwardly spaced from, the flight paths 12.

The major portions of the flight and return paths 12, 14 are in parallel vertical planes, the vertical planes of the return paths 14 being spaced outwardly from the vertical planes of the flight paths 12. The flight and return paths are connected at the entry end by an intermediate horizontal path 26 and at the exit end by an intermediate horizontal path 28.

Still referring to FIGS. 1 and 2 in particular, the travel path of conveyor 10 is defined in part by four generally vertically disposed curved guides 30, 32, 34, 36 and two generally horizontally disposed curved guides 38, 40. Of the four generally vertically disposed curve guides, two are disposed along the flight path 12, one guide 30 at the article-inversion segment 18 and one guide 32 at the article-re-inversion segment 22, and two are similarly disposed along the return path 14, one guide 34 horizontally outwardly spaced from guide 30 and one guide 36 horizontally outwardly spaced from guide 32. Of the two generally horizontally disposed curved guides 38, 40, one guide 38 is disposed adjacent the article-intake segment 16 and the other guide 40 is disposed adjacent the article-discharge segment 24.

It will be appreciated that the flight or working path 12 commences at the entrance end with horizontally disposed guide 38, extends upwardly around a portion of vertically disposed guide 30, travels longitudinally along the upper flight segment 20 an appreciable length, passes downwardly around a portion of vertically disposed guide 32 and terminates with horizontally disposed guide 40 at the exit end. The return or no-load path 14 commences with horizontally disposed guide 40 at the exit end, extends upwardly around a portion of vertically disposed guide 36, travels longitudinally an appreciable length (parallel to upper flight segment 20), passes downwardly around a portion of vertically disposed guide 34 and terminates with horizontally disposed guide 38 at the entry end. At the entry end the return path 14 is connected to the flight path 12 by intermediate path 26 extending around a portion of horizontally disposed curve guide 38, and at the exit end the paths 12 and 14 are connected by intermediate path 28 extending around a portion of horizontally disposed curve guide 40.

The vertically disposed curved guides 30, 34 at the entry end are in the form of generally vertically disposed wheels rotatable about a horizontal axis, and more particularly, fixed horizontal shaft 42, while the vertically disposed curved guides 32, 36 at the exit end are also wheels rotatable about a horizontal axis defined by a fixed common shaft 44. The horizontally disposed curve guides 38 and 40 are preferably wheels rotatable about their respective vertical axes, namely, shafts 46 and 48, respectively. Each of the vertically disposed wheels 30, 32, 34, 36 and the horizontally disposed wheel 38 at the entry end or article-intake segment 16 is an idler, while the other horizontally disposed wheel 40 at the exit end or article-discharge segment 24 is driven and constitutes a drive gear for the conveyor 10.

The travel path of conveyor 10' is identical to that of conveyor 10, but horizontally spaced therefrom, with the conveyor 10' traversing similar wheels on similar shafts indicated by primed similar numerals. The horizontally disposed wheel 38 traversed by conveyor 10 and its associated wheel 38' traversed by conveyor 10' constitute converging means for bringing the conveyors 10, 10' into article-grasping juxtaposition at the article-intake segment 26 just as the horizontally disposed wheel 40 traversed by conveyor 10 and its associated wheel 40' traversed by conveyor 10' together constitute diverging means for bringing the conveyors 10, 10' into article-releasing juxtaposition at the article-discharge segment 28.

The means for driving the conveyors 10, 10' along their respective travel paths include a common drive motor 50 operating through a drive sprocket 52 to drive (via separate driven sprockets 56, shafts 58, gear boxes 60, U-joints 62 and splined couplings 176) the vertically disposed rotatable shaft 40 of conveyor 10 and 40' of conveyor 10'. (Flexible covers 63 conceal the flexible drive including the U-joints 62 and splined couplings 176.) The drive sprocket 52 drives the sprocket 56 of conveyor 10 via a chain 54, and the sprocket 56 of conveyor 10' via an additional sprocket 64 and chain 66.

The Fixed Frame System

Referring now in particular to FIGS. 3–9, the substantially stationary and fixed basic frame of the rinsing machine comprises four vertical legs 100 (provided at the bottom with levelers), one at each corner, and four transverse members 102, two transverse members 102*a* being disposed above the upper level flight segment 20 and two transverse members 102*b* being disposed below the lower level article-intake and -discharge segments 16, 24. The frame further includes six longitudinal members 104, comprising two upper level longitudinal members 104*a* connecting the upper transverse members 102*a*, two lower level longitudinal members 104*b* connecting (via a mounting plate 105 at the discharge end) the transverse members 102*b*, and two intermediate level longitudinal members 104*c*. Dependent on the longitudinal length of the rinser, there may also be provided a longitudinally spaced plurality of braces including transversely spaced paired lower level vertical braces 106 (equipped with levelers at the bottom and supporting the intermediate longitudinal members 104*c* on the floor), transversely spaced paired upper level vertical braces 103 (supporting the upper level longitudinal members 104*a* on the intermediate level longitudinal members 104*c*), and transverse braces 101 (positioned atop the vertical braces 103 to rigidify further the upper level longitudinal members 104*a*).

Referring now in particular to FIGS. 5–9, three longitudinally spaced transverse adjustment screws 110*a*, 110*b*, 110*c* in a common horizontal plane are rotatably mounted in bearings secured to the intermediate longitudinal members 104*c* by means of angle irons 112. Each of the transverse screws 110 is actually composed of two oppositely threaded half screws 111 joined together by a coupling 114 (see FIG. 5) with pins 116 securing respective ends of the coupling 114 to the adjacent ends of the half screws 111. The three transverse screws 110*a*, 110*b*, and 110*c* are operatively connected for parallel rotation about their respective axes by means of sprockets and sprocket assemblies 120 mounted on each of the screws for rotation therewith and chains 122 connecting the sprockets 120 of transverse screws 110*a* and 110*b* and the sprockets 120 of transverse screws 110*b* and 110*c*. Thus, rotation of the transverse screw 110*a* is transmitted, by means of the sprockets 120 and chains 122, to the transverse screws 110*b* and 110*c* so that they undergo similar rotation.

A hand wheel 124 is mounted on a shaft 125 which extends horizontally through the intermediate longitudinal member 104*c* at one side of the rinser and terminates in a bushing 126 (disposed in the intermediate longitudinal member 104*c*) and set collar 128. The end of transverse screw 110*a* adjacent the hand wheel 124 terminates in a spur gear 127 operated by another spur gear 129 mounted on the shaft 125 for rotation therewith. Thus rotation of the handwheel 124 acts through shaft 125, spur gear 129 and spur gear 127 to cause rotation of the transverse screw 110*a* and hence (via sprockets 120 and chains 122) transverse screws 110*b*, 110*c*. For safety, a mesh 130 encloses the spur gears 127, 129.

The stationary frame further includes three longitudinally spaced transverse slide bars 131*a*, 131*b*, 131*c* mounted on angle bars 132 secured on top of longitudinal members 104*c*. The slide bars 131*a*, 131*b*, 131*c* are mounted adjacent transverse screws 110*a*, 110*b*, 110*c*, respectively, with the outer slide bars 131*a*, 131*c* being mounted outwardly of transverse screws 110*a*, 110*c* and slide bar 131*b* being mounted on the entrance end side of transverse screw 110*b*.

The Movable Frame System

Referring now to all of the figures, in addition to the above-described substantially stationary fixed frame, there is also a movable frame comprising a pair of massive longitudinal beams, one longitudinal beam 140 being associated with the conveyor 10 and the other longitudinal beam 140' being associated with the conveyer 10'. Each beam 140, 140' is mounted for support on each of the three transverse slide bars 131*a*, 131*b* and 131*c* (see FIG. 8) and for horizontal adjustment on each of the three transverse screws 110*a*, 110*b* and 110*c* (see FIG. 9). To enable the longitudinal beams 140, 140' to slide horizontally back and forth along the transverse slide bars 131, without damage to either part, the beams 140, 140' are mounted on longitudinal wear strips 133 by means of vertical set screws 134 securing flanges of the beams to the wear strips 133 and horizontal set screws 135 which preclude rotation of the vertical set screws 134. (See FIG. 8.) Secured to each of the beams 140, 140' at each point where it engages one of the transverse screws 110 is an internally threaded nut 142, 142', respectively, the nuts of the two beams being disposed on externally threaded portions of different halves of the transverse screws 110 so that, as the transverse screws 110 rotate, the beams 140, 140' are drawn either together or apart. As the arrangement of sprockets 120 and chains 122 ensure that all of the transverse screws 110 undergo the same direction and degree of rotation and since the action of the transverse screws 110 is applied to the beams 140, 140' adjacent the ends and center thereof, the parallel orientation of the beams is maintained despite their horizontal movement along the transverse supports 131 (either closer together or further apart, as illustrated by the double ended arrows of FIG. 9).

Adjacent each end of each longitudinal beam 140, 140' is a sleeve 150 extending through its respective beam end. With regard to longitudinal beam 140, the transverse shaft 42 is non-rotatably mounted within the sleeve 150 at the article-inversion segment 18 of conveyor 10, and the transverse shaft 44 is non-rotatably mounted within the sleeve 150 at the article-re-inversion segment 22 of conveyer 10. On the projecting ends of the transverse shaft 42 are mounted the idler wheel assemblies for wheels 30 and 34, respectively, while on the extending ends of the transverse shaft 44 are mounted the idler wheel assemblies for wheels 32, 36, respectively. With regard to longitudinal beam 140', transverse shafts 42', 44' and idler wheels 30', 32', 34', 36' occupy corresponding positions at the corresponding segments of conveyor 10'. Thus it will be noted that the longitudinal beam 140, transverse shafts 42, 44, vertically disposed wheels 30, 32, 34 and 36, and the conveyor 10 carried thereby comprise one movable subframe, and the longitudinal beam 140', its transverse shafts 42', 44', and its wheels 30', 32', 34', 36' and its conveyor 10' comprise another movable subframe. The movable sub-frames may be moved closer together so as to bring the flight paths 12 closer for the grasping of articles A of small diameter or further apart for the grasping of articles A of large diameter, all by appropriate rotation of the handwheel 124.

Each of the vertically disposed idler wheels 30, 32, 34, 36 and their primed counterparts comprises a hub or bearing portion 154 mounted on the appropriate transverse shaft 40, 42, 40', 42' for independent rotation, a rigid metal disc portion 156 of greater diameter and a wearable portion 158 of still greater diameter, the portions 154, 156 and 158 being operatively connected for rotation as a unit. The hub portion 154 faces the appropriate beam 140, 140' and is secured to the appropriate transverse shaft for rotation independent thereof, the rigidifying metal portion 156 provides support for the wearable portion 158, and the wearable portion 158 is the portion of the wheel assembly that actually supports the conveyor 10, 10' during its traverse of the article-inversion segment 18 or article-re-inversion segment 22. An arrangement of nuts and washers (not shown) at the free ends of the transverse shafts maintain the bearings 154 of the wheel assemblies rotatably on the transverse shafts, the free ends being packed with grease and protected from dust and water by covers 152.

Each conveyor 10, 10' comprises a tab chain 160 having a plurality of longitudinally spaced compressible rubber grippers 162 mounted thereon. For each conveyor 10, 10', the tab chain 160 rides on the wearable portions 158 of four vertically disposed idler wheels and the one horizontally disposed idler wheel 38, 38' adjacent the article-intake segment 16 and is meshingly engaged and driven by the one horizontally disposed driven socket 40, 40' of the article-discharge segment 24 associated with the conveyor 10, 10'.

Figure 5A:
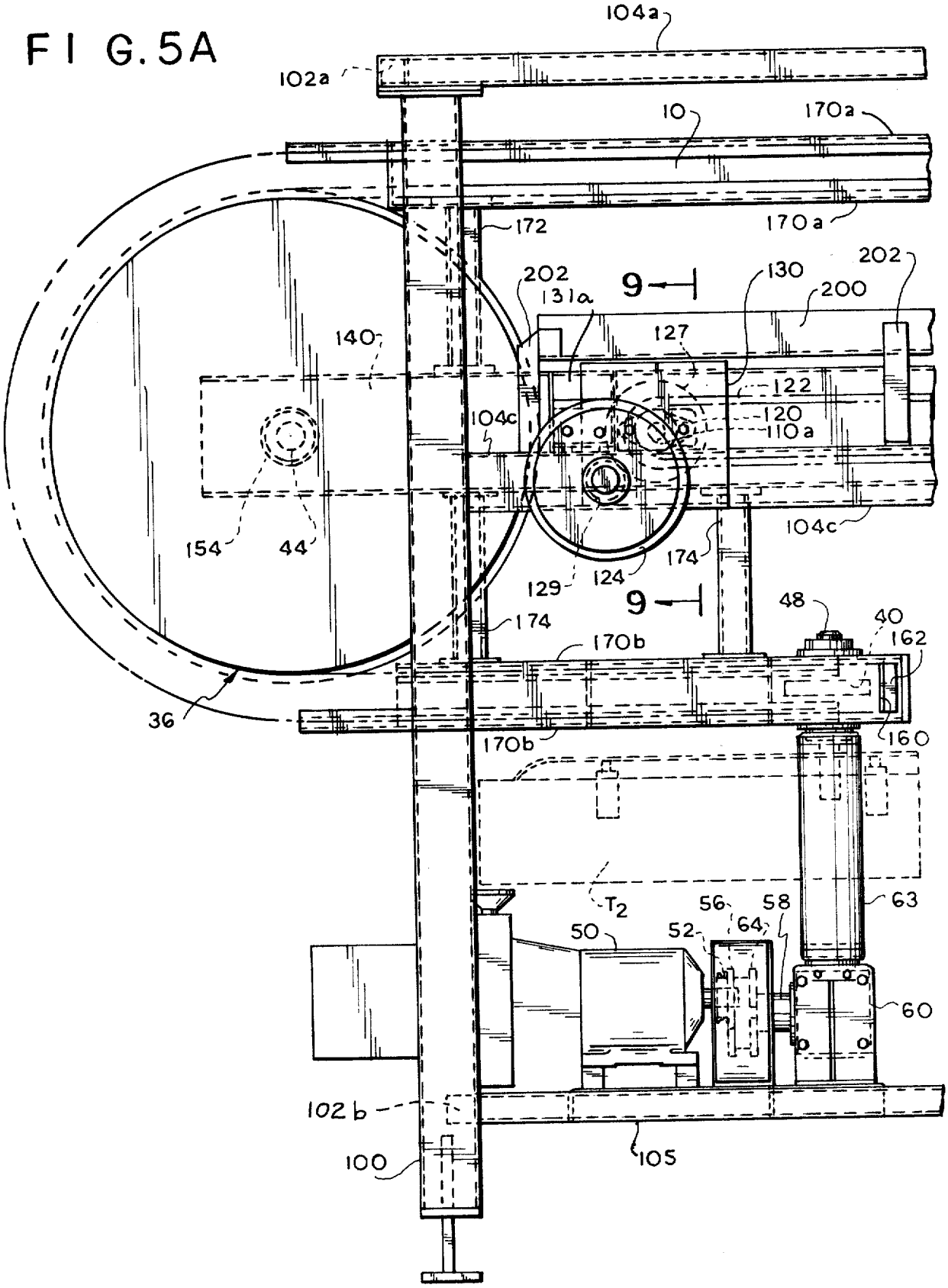
FIGS. 5A, 5B and 5C are in combination a fragmentary side elevation view of a rinser according to the present invention.
Figure 5B:
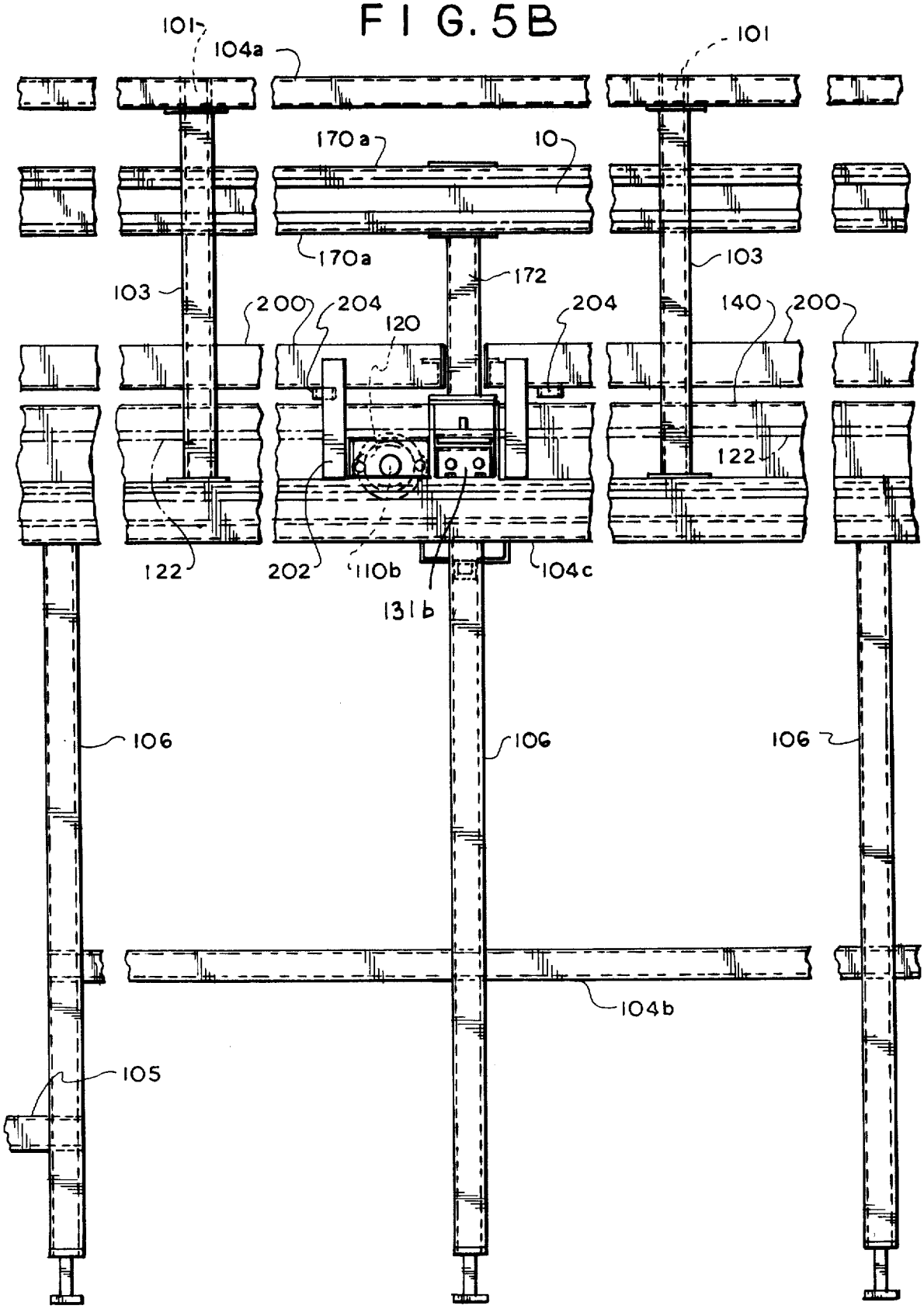
Figure 5C:
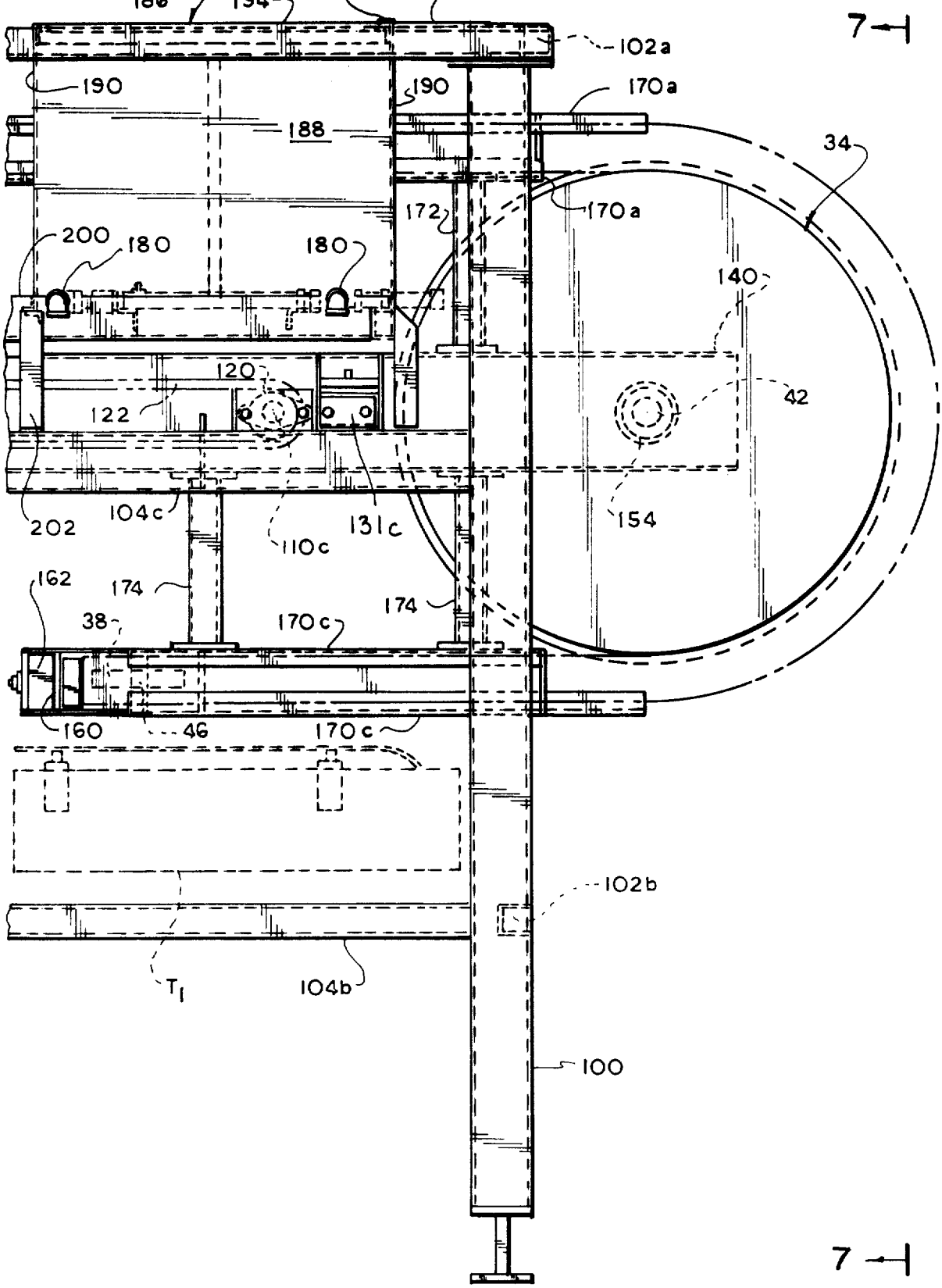
Figure 6:
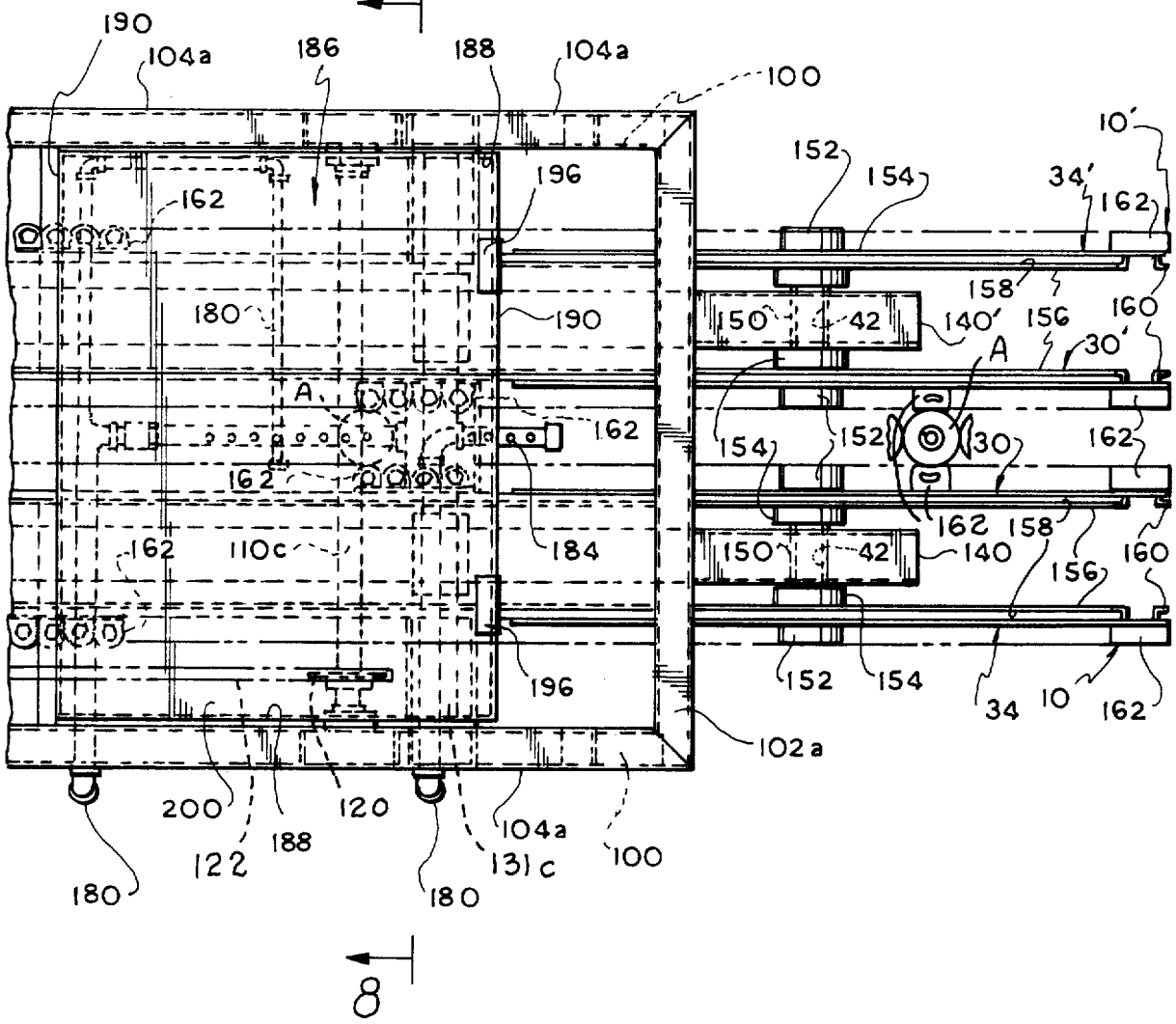
FIG. 6 is a fragmentary top plan view of the rinsing section of the rinser of FIG. 1.
Figure 7:
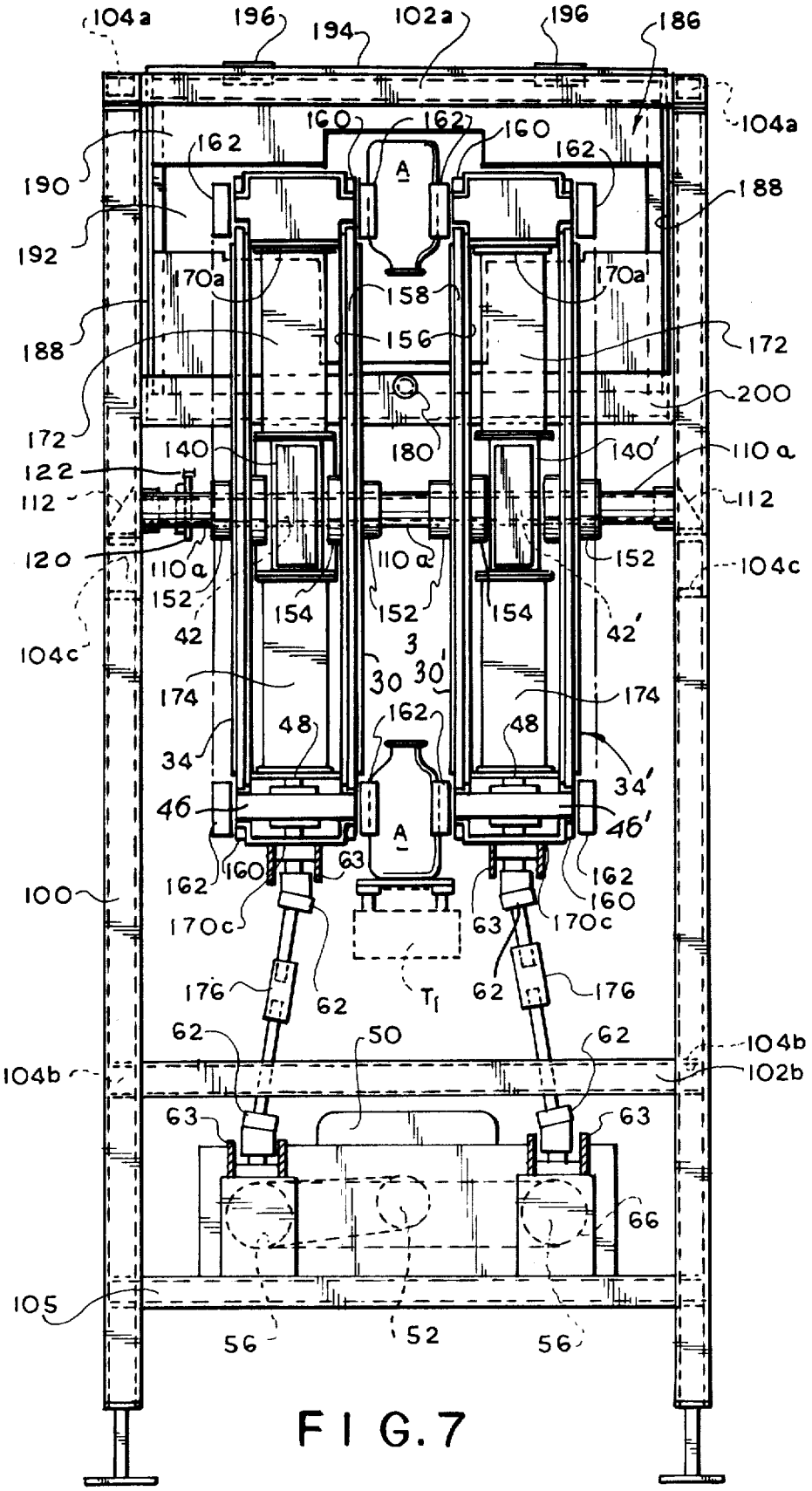
FIG. 7 is an end elevation view of the entrance end of the rinser, taken along the line 7—7 of FIG. 5C.
Figure 8:
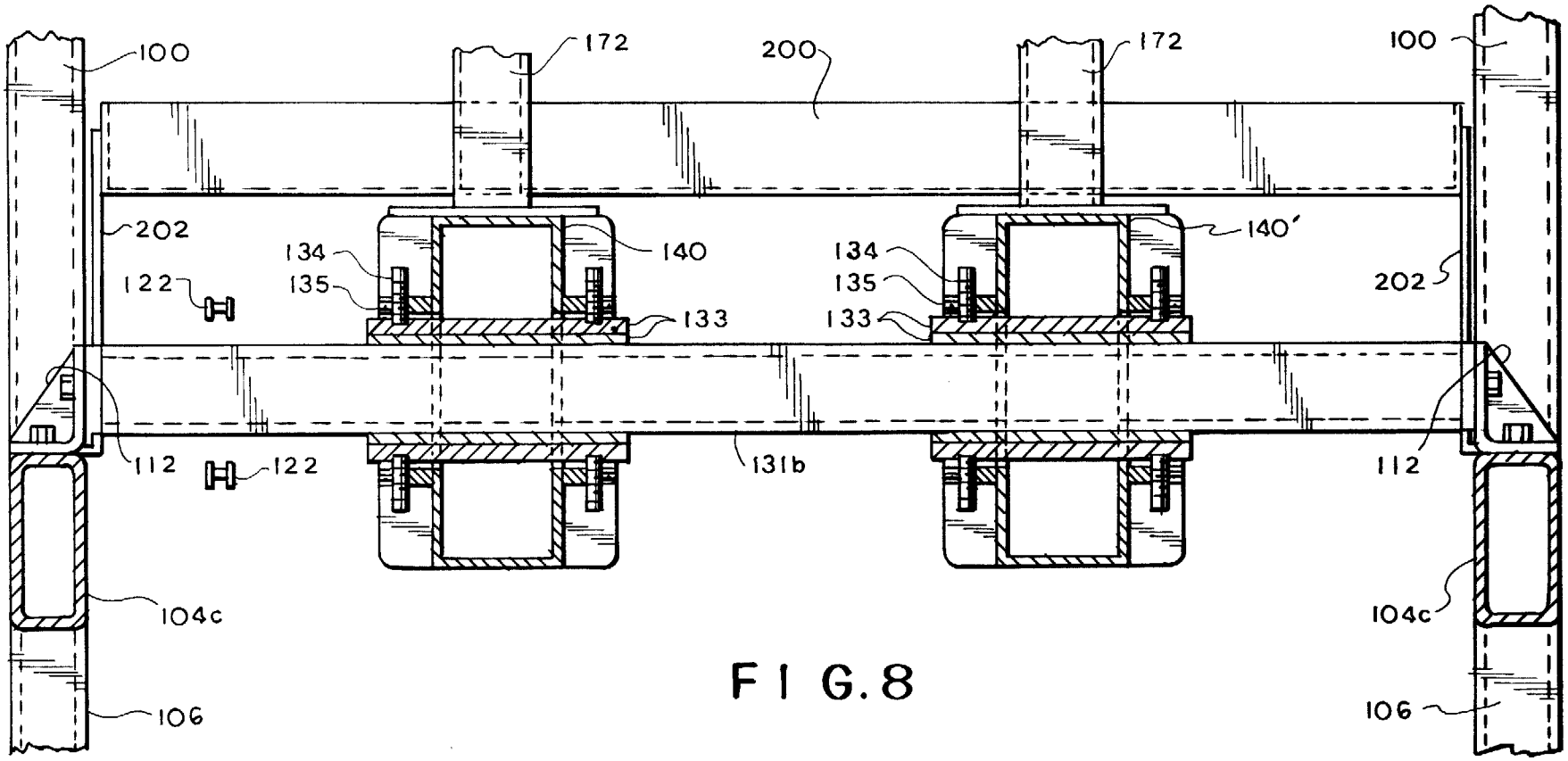
FIG. 8 is a vertical transverse section, to an enlarged scale, taken along the line 8—8 of FIG. 6.
Figure 9:
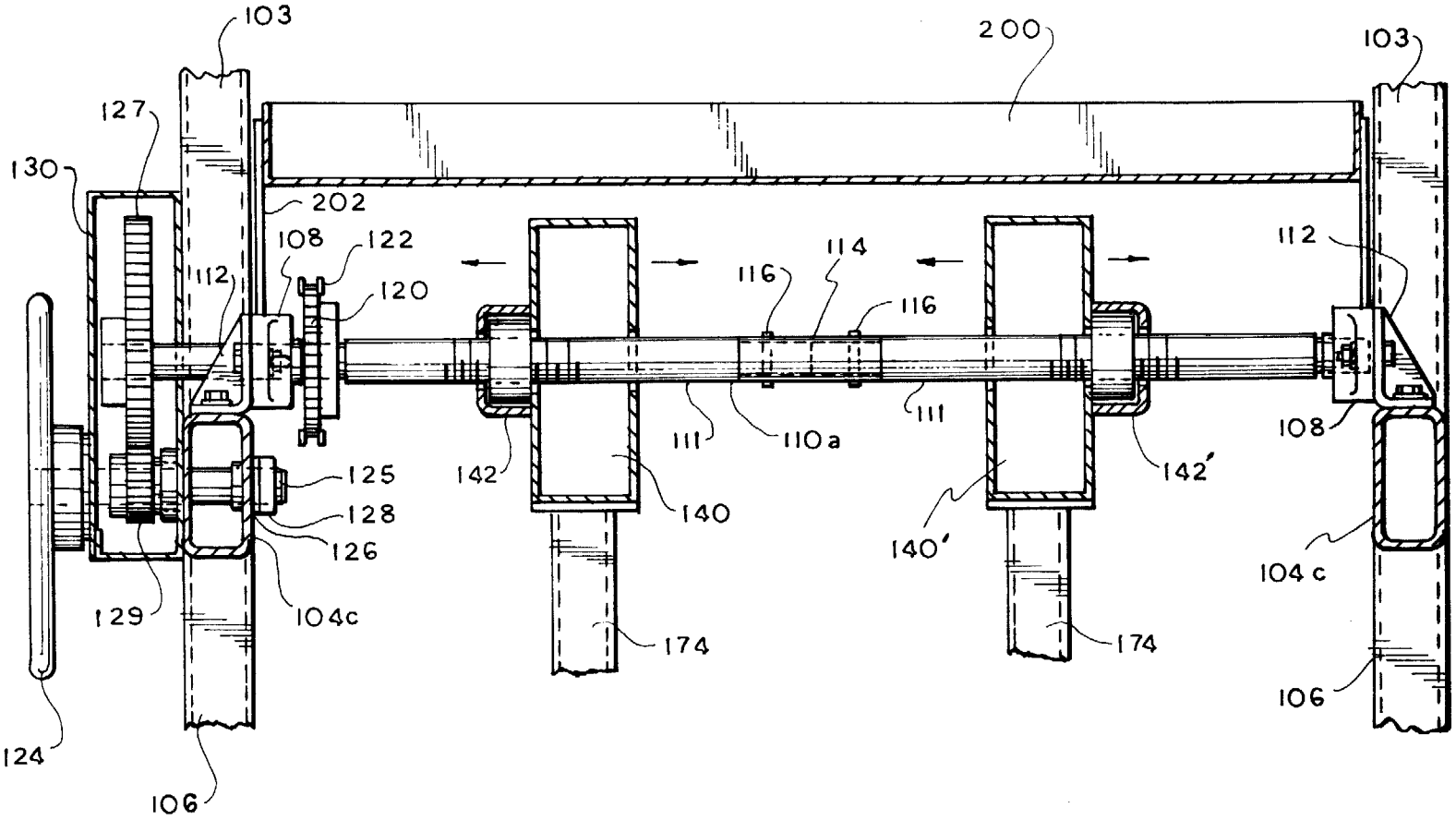
FIG. 9 is a vertical transverse section, to an enlarged scale, taken along the line 9—9 of FIG. 5A.

Referring now in particular to FIGS. 5–7 the movable sub-frame further includes, for each conveyor 10, 10', a conveyor support frame generally designated by the numeral 170, which essentially tracks the travel path of the conveyor and encloses and provides support therefor at all locations except the segments of the travel path where the conveyors are in contact with the vertically disposed idler wheels. More specifically, each conveyor support frame 170 comprises two horizontally spaced upper level segments 170*a* extending longitudinally between the tops of each one of a pair of longitudinally spaced vertically disposed idler wheels in a vertical plane, a pair of horizontally spaced lower level segments 170b in the region of the article-discharge segment 24 and a pair of horizontally spaced lower level segments 170c in the region of the article-intake segment 16. Each upper level segment 170a is secured to its respective longitudinal beam 140, 140' by means of three longitudinally spaced, vertically extending posts 172, while the lower level segments 170b and 170c are each secured to the longitudinal beams by means of a pair of posts 174 depending from the longitudinal beams.

It will be appreciated that the conveyor support means 170a associated with the flight paths of the conveyors assist in retaining the conveyors in an article-grasping juxtaposition between the article-intake segment 16 (and more particularly the converging means 38, 38') and the article-discharge segment 24 (and more particularly the diverging means 40, 40'). The conveyor supports 170c for the article-intake segment 16 also support the rotatable shafts 46, 46' of the horizontally disposed idler wheels 38, 38' while the conveyor supports 170b for the article-discharge segment 24 also support the rotatable shafts 48, 48' of the horizontally disposed driven gear 40, 40'. While the bottom portions of the conveyor support frame segments 170 are load-bearing, the side and upper portions are primarily to protect the conveyor from dirt, water, etc., and hence may be of light-weight, preferably transparent plastic.

In order to accommodate the motor and drive system for the rinser, each lower longitudinal member 104b is actually composed of two segments, an upper segment extending from the article-entry side of the rinser towards the vertical braces 106 closest to the article-exit end of the rinser and a lower common horizontal plate 105 extending from such vertical leg braces 106 to the vertical members 100 at the other end of the rinser, the lower level of plate 105 enabling the drive mechanism to be situated thereon without interfering with other aspects of the rinser. While the drive motor 50 and gear boxes 60 are fixed, on horizontal plate 105 as shown in FIG. 5A, the output of the gear boxes 60 is directed through U-joints 62 and splined couplings 176 (within cover 63) to enable the output to accommodate the limited adjustment afforded by movement of the conveyor supports 170b in response to movement of the beams 140, 140'.

Referring now to FIGS. 5 and 7, therein illustrated in phantom line are a conventional article-intake table $T_1$ disposed directly under the article-intake segment 16 and extending between horizontally disposed wheels 38, 38' and a conventional article-discharge table $T_2$ disposed directly under the article-discharge segment 24 and extending between the driven horizontally disposed wheels 40, 40'. The tables $T_1$, $T_2$ are typically in-feed and out-feed portions of conveyors of the user and are illustrated simple to facilitate understanding of the present invention.

The Plumbing System

Turning now to consideration of the plumbing aspects of the rinser, and referring in particular to FIGS. 5–7, approximately the third of the fixed frame of the rinser adjacent the article-intake segment 16 contains intermediate the lower and upper levels a network of pipes 180 connected to a water source (not shown) for spraying water upwardly through longitudinally spaced nozzles 184 aligned along a longitudinal axis intermediate the upper level flight paths 12 of conveyors 10, 10'. In order to prevent the resulting spray of water from escaping the general area of the rinser, an open bottomed rinse box 186 is provided. The rinse box 186 includes sidewalls 188 disposed just inwardly of the longitudinal members 104a and extending downwardly to a point slightly above the longitudinal beams 140, 140'. The front and rear walls 190 of the rinse box 186 join the sidewalls 188 to limit the escape of water and define apertures 192 to enable the passage therethrough of the conveyors 10, 10', the upper level conveyor support portions 170a and the articles A being transported by the conveyors. The top of the rinse box 186 is provided with a cover 194 secured thereto by hinges 196, so as to enable easy access to the rinse box, if necessary. A pair of longitudinally spaced drain pans 200 are provided to catch water draining from the articles A as they traverse the upper level flight segment and are secured above the longitudinal beams 140, 140' by a plurality of longitudinally spaced vertically extending supports 202 secured to the intermediate longitudinal members 104c. The portion of the drain pan 200 extending beneath the open-bottomed rinse box 186 acts as the bottom for the rinse box. The drain pans are connected by drain pipes 204 to suitable drains (not shown).

Figure 3:
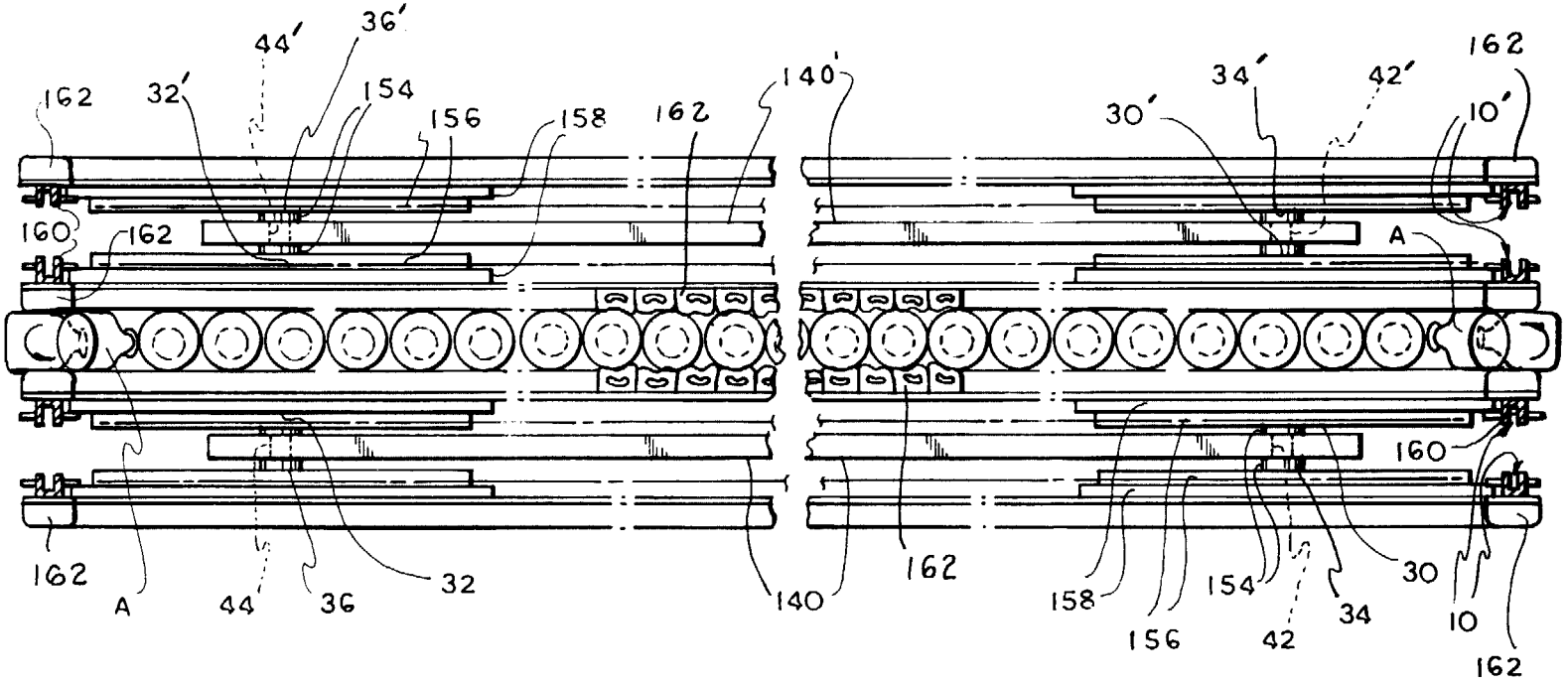
FIG. 3 is a fragmentary top plan view of the upper level of the rinser taken along the line 3—3 of FIG. 2.
Figure 4:
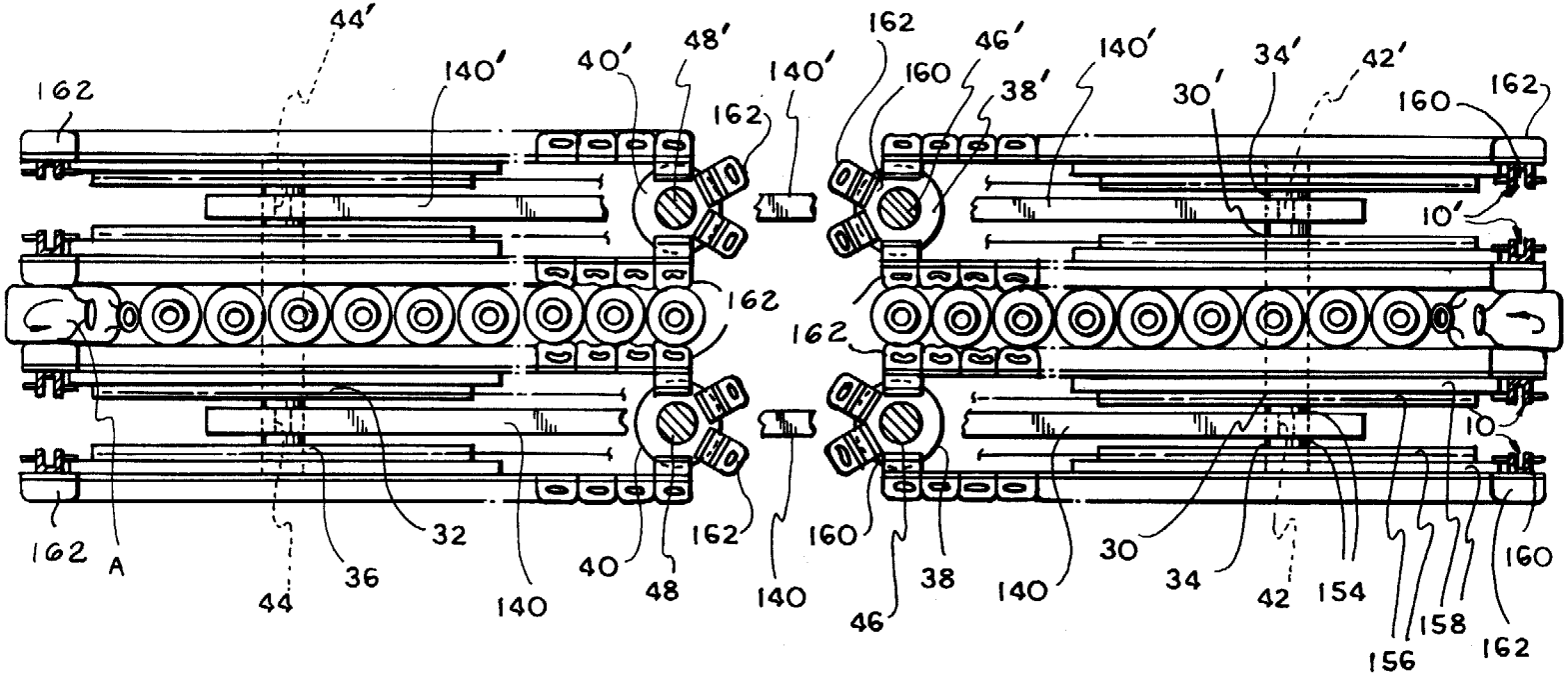
FIG. 4 is a fragmentary top plan section of the lower level of the rinser taken along the line 4—4 of FIG. 2.

It will be appreciated that FIGS. 2 through 4 represent simplified views of the embodiment of FIGS. 5 through 9, with certain elements being omitted in order to clarify the details of what is shown.

The sliding surfaces of the rinser—for example, the bottoms of the conveyor support frames 170 upon which the conveyors ride, the wear strips 133 on which the longitudinal beams 140, 140' ride, and the wearable portions 158 of the wheels on which the conveyors ride—are preferably formed of a low friction wearable surface such as ultra-high molecular weight polyethylene.

Operation

In operation of the rinser, bottles A to be rinsed are introduced to the rinser via the article-intake table $T_1$, which may simply be one end of a user's conveyor. At the lower-level article-intake segment 16 the conveyors 10, 10' are converging (from the horizontally disposed idlers 38, 38') and will firmly and securely grasp the bottles between the compressible rubber grippers 162. The conveyors, guided by the conveyor support frame segments 170c bring the articles to the idler wheels 30, 30' at the article-inversion segments 18, where the articles are raised to the upper level and simultaneously inverted. From there the conveyors, maintained in article-grasping juxtaposition by the conveyor support frame segments 170a, carry the articles through the rinse box 186, the conveyor support frame segments 170a being sufficiently spaced apart to allow flushing of the articles with the water stream emanating from the nozzles 184 of pipes 180. After the rinser box 186, the conveyors continue to carry the articles along the upper level where the articles drip dry, the water therefrom being collected in the drain pans 200. Eventually the conveyors carry the articles to the article-re-inversion segment 22 where the idler wheels 32, 32' lower the articles down to the lower level and at the same time re-invert them. The conveyors, guided by the conveyor support frame segments 170b, then transport the articles to the article-discharge segment 24 where the conveyors are diverging, each conveyor traveling its intermediate path 28 around its respective driven wheel 40, 40'. The driven wheels 40, 40' are rotated by shafts 48 connected to gear boxes 60 and the common drive motor 50.

On the return paths, the conveyors 10, 10' are carried around vertically disposed idlers 36, 36' respectively, to reach the upper level, traverse the full longitudinal length of the upper level (parallel to but spaced outwardly from the flight path) and are finally returned the the lower level by vertically disposed idlers 34, 34'. The conveyors then follow the intermediate paths 26 about the horizontally disclosed idlers 38, 38' respectively, where they again start to converge and grasp articles.

In order to adjust the rinser for articles of different widths, the hand wheel 124 is rotated in the appropriate direction, thereby causing corresponding rotation of all three transverse adjustment screws 110 (as a result of sprockets 120 and chains 122). The rotation of the transverse screws 110 causes the nuts 142, and hence the longitudinal beams 140, 140' to slide closer together or further apart on their transverse slide bars 131. Each beam 140, 140' carries with it a movable frame including its horizontally disposed drive wheels 40, 40' (as well as certain portions of the drive mechanism), its horizontally disposed idler wheel 38, 38', its four vertically disposed idlers 30, 32, 34 and 36 or 30', 32', 34' and 36', its conveyor 10, 10' and its conveyor support frame 170 associated therewith.

The grippers 162 of the conveyors have been illustrated as each having a hollow bubble shape which normally depresses slightly (about 1/16 of an inch) as it grasps the article. Even where the article is not aligned with the center of the opposed grippers, it will still be effectively held with the forward portion being retained between a pair of opposed forward grippers and the trailing portion being retained between a pair of opposed trailing grippers. The bubble type of gripper is particularly advantageous as it may be easily secured to and removed from studs appropriately placed on the tab chain 160. Thus should an individual gripper 162 become damaged, it may be simply and rapidly replaced without disturbing other grippers or affecting the tab chain. Other compressible grippers may also be utilized, for example, finger grippers having a generally U-shaped configuration with the legs or fingers of the U extending towards the article to be transported. Such finger grippers are typically permanently mounted on the tab chain so that, in order to replace a single injured finger gripper, the associated segment of the chain must be replaced as well.

The compressible grippers 162 of the conveyors may be formed of rubber or resilient plastic so as to enable fragile articles or even deformable articles, such as plastic bottles, to be safely transported by the conveyor. The grippers should be sufficiently deformable that a potential jam of the articles being fed to the conveyors has an opportunity to work itself out without crushing of the containers. It will also be appreciated that the resilient nature of the grippers enables the conveyor to accept a random input of the articles to be rinsed. Regardless of the longitudinal spacing of the articles being fed into the converging conveyors, and even if the articles being fed are not aligned perfectly between the conveyors, the resiliency of the grippers will gently reposition the articles to an optimum orientation for the rinsing operation.

It will be appreciated that, with the exception of the conveyor support frame elements which guide the conveyors in straight paths, the conveyors are supported and guided by wheels, in all but one instance idler wheels. In particular, the conveyors do not pass over the high friction curved guides typically found in inverter and reinverter systems. Accordingly, power requirements for the conveyors is relatively low compared with that typically required for rinsers. Furthermore, as only minimal friction will be encountered, the chain requires little, if any, grease or lubrication, and, accordingly, the chance of such grease or lubrication being deposited by the rinse water on the article exteriors is reduced or eliminated.

To summarize, the present invention provides a rinser which is easily adjusted to handle articles of varying diameter, which safely handles fragile articles, which accepts a randomly spaced input of the articles to be rinsed, and which performs all this in the context of a machine which is safe, economical and easy to operate.

Now that the preferred embodiments of the present invention have been shown and described in detail, various modifications and improvements thereon will become readily apparent to those skilled in the art. Accordingly, the spirit and scope of the present invention is to be limited only by the appended claims and not by the foregoing disclosure.

We claim:

1. A rinsing machine for articles of glassware or the like comprising (A) a pair of endless conveyors, each of said conveyors defining a travel path comprising a flight path and a return path, said flight path extending from a lower level article-intake segment through an upwardly-extending article-inversion segment, along an upper flight segment of appreciable length, through a downwardly-extending article-re-inversion segment, and to a lower level article-discharge segment, said return path being spaced from said flight path, said upper flight segment extending in a substantially horizontal plane;

(B) converging means for bringing said conveyors into article-grasping juxtaposition at said article-intake segment, diverging means for bringing said conveyors into article-releasing juxtaposition at said article-discharge segment, and means for retaining said conveyors in said article-grasping juxtaposition between said article-intake and article-discharge segments;

(C) means for rinsing inverted articles traveling along said upper flight segment; and (D) means for driving each of said conveyors along its respective travel path.

2. The machine of claim 1 wherein the major portions of said flight and return paths are in parallel vertical planes, the vertical planes of said return paths being spaced outwardly of the vertical planes of said flight paths.

3. The machine of claim 1 wherein said return path is generally parallel to and spaced from said flight path.

4. The machine of claim 1 wherein said converging means and said diverging means are generally horizontally disposed curved guides disposed adjacent said article-intake segment and said article-discharge segment, respectively.

5. The machine of claim 4 wherein said horizontally disposed curved guides are wheels, each wheel being rotatable about a generally vertical axis.

6. The machine of claim 4 wherein for each of said conveyor travel paths, said flight and return paths are connected at each end by intermediate paths extending around respective ones of said horizontally-disposed curved guides.

7. The machine of claim 4 wherein, for each of said conveyor travel paths, said drive means comprises exclusively means for rotating one of said horizontally disposed curved guides.

8. The machine of claim 4 further comprising, for each of said conveyors, four generally vertically disposed curved guides, two of said vertically disposed guides being disposed along said flight path, one each at said article inversion and re-inversion segments, and two of said vertically disposed curved guides being similarly disposed along said return path.

9. The machine of claim 8 wherein said vertically disposed curved guides are wheels, each rotatable about a generally horizontal axis.

10. The machine of claim 1 further comprising, for each of said conveyors, four generally vertically disposed curved guides, two of said vertically disposed curved guides being disposed along said flight path, one each at said article inversion and re-inversion segments, and two of said vertically disposed curved guides being similarly disposed along said return path.

11. The machine of claim 10 wherein said vertically disposed curved guides are wheels, each rotatable about a generally horizontal axis.

12. The machine of claim 11 wherein all of said vertically disposed wheels are idlers.

13. The machine of claim 11 wherein, for each of said conveyor travel paths, said two vertically disposed wheels at said article inversion segments are mounted on a common horizontal shaft and said two vertically disposed wheels at said article re-inversion segments are mounted on a common horizontal shaft.

14. The machine of claim 11 further comprising means for adjusting the horizontal spacing between said four vertically disposed wheels of one of said conveyor travel paths and said four vertically disposed wheels of the other of said conveyor travel paths.

15. The machine of claim 1 further comprising means for adjusting the horizontal spacing between said travel paths of said conveyors.

16. The machine of claim 1 further comprising means for adjusting the horizontal spacing between said converging, diverging and retaining means.

17. The machine of claim 1 wherein said article-intake and article-discharge segments are in a common horizontal plane.

18. The machine of claim 1 wherein said flight paths and said return paths are in substantially horizontal planes respectively intermediate said article-inversion segments and said article-re-inversion segments.

19. The machine of claim 1 for articles of glassware or the like having an open end wherein said travel paths maintain the article open end facing inwardly at all times.

20. The machine of claim 1 adapted for use with a randomly spaced input of articles wherein said conveyors accommodate and substantially maintain the original spacing of the articles.

21. A rinsing machine for articles of glassware or the like comprising (A) a pair of endless conveyors, each of said conveyors defining a travel path comprising a flight path and a return path, said flight path extending from a lower level article-intake segment through an upwardly-extending article-inversion segment, along an upper flight segment of appreciable length, through a downwardly-extending article-re-inversion segment, and to a lower level article-discharge segment, said return path being spaced from said flight path, the major portions of said flight and return paths being in parallel vertical planes, the vertical planes of said return paths being spaced outwardly of the vertical planes of said flight paths;

(B) converging means for bringing said conveyors into article-grasping juxtaposition at said article-intake segment, diverging means for bringing said conveyors into article-releasing juxtaposition at said article-discharge segment, and means for retaining said conveyors in said article-grasping juxtaposition between said article-intake and article-discharge segments;

(C) means for rinsing inverted articles traveling along said upper flight segment; and (D) means for driving each of said conveyors along its respective travel path.

22. The machine of claim 21 wherein said return path is generally parallel to and spaced from said flight path.

23. A rinsing machine for articles of glassware or the like comprising (A) a pair of endless conveyors, each of said conveyors defining a travel path comprising a flight path and a return path, said flight path extending from a lower level article-intake segment through an upwardly-extending article-inversion segment, along an upper flight segment of appreciable length, through a downwardly-extending article-re-inversion segment, and to a lower level article-discharge segment, said return path being spaced from said flight path;

(B) for each of said conveyors, four generally vertically disposed curved guides, two of said vertically disposed curved guides being disposed along said flight path, one each at said article inversion and re-inversion segments, and two of said vertically disposed curved guides being similarly disposed along said return path.

24. The machine of claim 23 wherein said vertically disposed curved guides are wheels, each rotatable about a generally horizontal axis, and for each of said conveyor travel paths, said two vertically disposed wheels at said article inversion segments are mounted on a common horizontal shaft and said two vertically disposed wheels at said article re-inversion segments are mounted on a common horizontal shaft.

* * * * *